United States Patent [19]

Ayer

[11] 4,043,627

[45] Aug. 23, 1977

[54] DEVICES, METHODS, AND COMBINATIONS FOR SECURING ELECTRICAL CONNECTORS TOGETHER

[75] Inventor: George Edward Ayer, Endicott, N.Y.

[73] Assignee: Bunker Ramo Corporation, Oak Brook, Ill.

[21] Appl. No.: 626,023

[22] Filed: Oct. 28, 1975

[51] Int. Cl.[2] ..... H01R 13/54

[52] U.S. Cl. ..... 339/75 R; 24/DIG. 18; 174/138 F; 339/91 R

[58] Field of Search ..... 339/38, 75 R, 75 A, 339/75 M, 91 R, 101, 120, 121, 172, 210 R, 212, 249 S, 251; 174/138 F, 6; 24/204, DIG. 18

[56] References Cited

U.S. PATENT DOCUMENTS

| | | | |
|---|---|---|---|
| 2,725,543 | 11/1955 | Tanner | 339/91 R X |
| 3,475,810 | 11/1969 | Mates | 339/75 R X |
| 3,499,102 | 3/1970 | Gillemot et al. | 174/138 F |
| 3,585,569 | 6/1971 | Moran | 339/75 R |
| 3,659,248 | 4/1972 | Mann et al. | 339/91 R X |
| 3,824,552 | 7/1974 | Kirby | 339/91 R X |
| 3,828,302 | 8/1974 | Ciewiawa et al. | 339/91 R |

*Primary Examiner*—Roy Lake
*Assistant Examiner*—E. F. Desmond
*Attorney, Agent, or Firm*—William Lohff; F. M. Arbuckle

[57] ABSTRACT

Devices, methods, and combinations for securing electrical connectors, wherein one of the connectors has a pair of mounting holes for facilitating mounting to a panel having cooperating mounting holes therein and an intermediate slot to permit passage of a portion of an electrical connector therethrough, can utilize a device which includes a flexible and sturdy planar member having a pair of mounting holes therein oriented so as to co-align with holes in the one connector and the panel. The planar member has a cooperating slot at least as large as the panel slot, and is formed so that two substantive portions can be folded at right angles in a U shape along parallel lines extending from opposite sides of the slot, the folded portions having inner surfaces facing each other with a space therebetween for housing the other connector. In one embodiment, a first strip of fastening means is affixed to the outer surface of one of the portions distant from the slot, and a second strip of cooperating fastening means is affixed to the inner surface of the other of the portions distant from the slot. One strip contains hook elements, the other contains loop elements. The planar member is formed with slits extending from the mounting holes to the rectangular slot to allow for retrofitting to an already existing bolted panel connector without removing the connecting bolts. Optionally, the fastening means can be affixed to surfaces which face each other, so as to engage with cooperating fastening means affixed to the cable connector. Combinations include the use of such a device in connection with the panel connector, the cable connector, and the panel substrate. Further detailed embodiments are also disclosed.

35 Claims, 17 Drawing Figures

FIG. 3
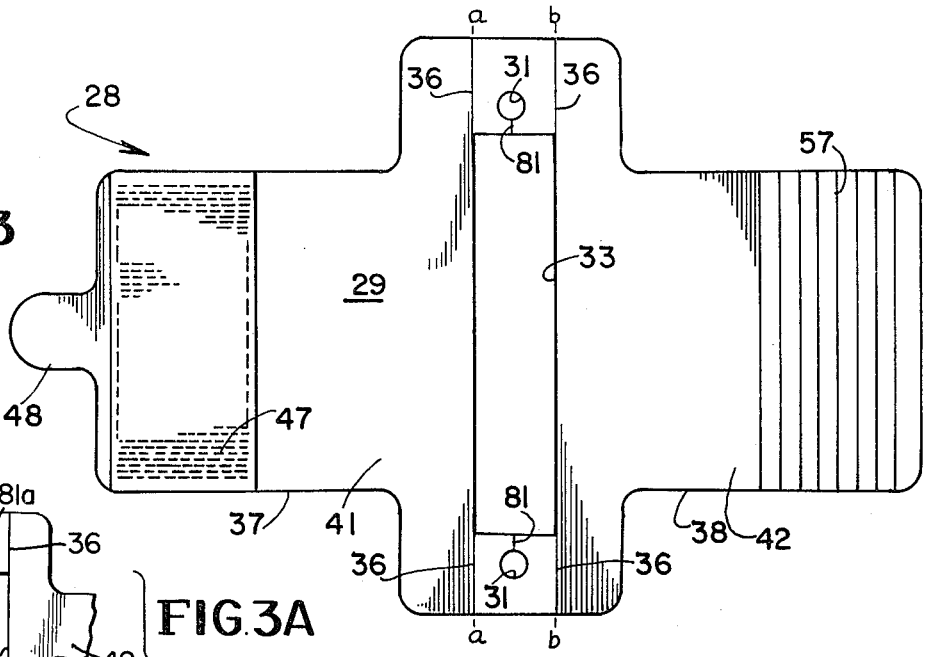
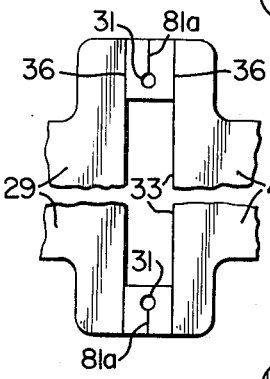
FIG.3A
FIG. 4
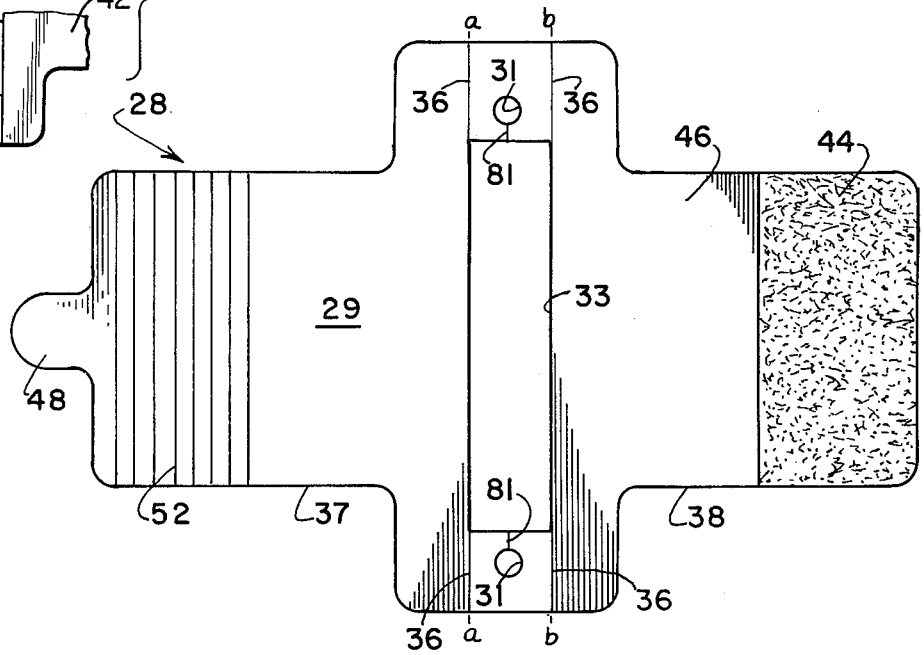
FIG. 5
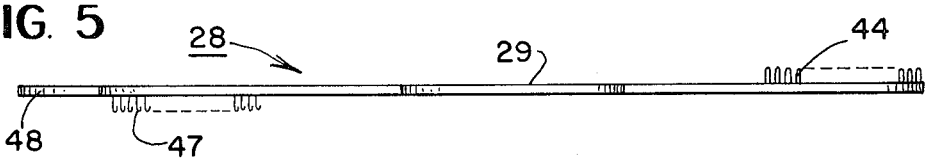

DEVICES, METHODS, AND COMBINATIONS FOR SECURING ELECTRICAL CONNECTORS TOGETHER

BACKGROUND OF THE INVENTION

1. Field of the Invention

This invention relates to devices, methods, and combinations for securing electrical connectors together. Accordingly, it is a general object of this invention to provide new and improved devices, methods, and combinations of such character.

2. Description of the Prior Art

In accordance with a preliminary novelty search performed on behalf of the inventor, the following U.S. Patents were deemed to be of some interest:

| U.S. Pat. No. | Patentee |
|---|---|
| Keiner | 889,786 |
| Neill | 2,432,120 |
| Klostermann | 2,669,702 |
| Munz et al | 3,086,529 |
| Roelsgaard et al | 3,239,794 |
| Trunk | 3,266,655 |
| Wallach | 3,279,008 |
| Park, Sr. et al | 3,327,410 |
| Frederick | 3,489,986 |
| Muckinhaupt | 3,516,300 |
| Waller, Sr. | 3,551,879 |
| Gley | 3,575,685 |
| Moran | 3,585,569 |
| Ray | 3,640,273 |
| Klotz et al | 3,688,348 |
| Moore | 3,827,107 |

The field of search included class 24: subclasses 204 and digest 18.

Keiner, U.S. Pat. No. 889,796, issued June 2, 1908, suggests the interlocking of a pair of connector members having a formed and aligned circumferential groove. A wire 26 is then wound around the groove to prevent separation by vibration or otherwise. Thus, a connection is made without employing screws or devices which may work loose by vibration.

Neill, U.S. Pat. No. 2,432,120, issued Dec. 9, 1947, shows a plug and jack being firmly latched via lugs 57 which receive a hasp 58.

Klostermann, U.S. Pat. No. 2,669,702, issued Feb. 16, 1954, shows a connector 11 fixed to a partition 10. A second mating connector can be positively engaged with a first connector by means of levers 63 on each side of the connector 12 which engage with anchor projections 66 on the receptacle 11.

Munz et al, U.S. Pat. No. 3,086,529, issued Apr. 23, 1963, relates to a constrictor (a medical appliance), including an elastic band. Fabric reinforces one end of the elastic band; on the surface opposite the fabric are Velcro hooks. Fabric reinforces the other end of the elastic band on the same surface; on the opposite surface are located Velcro hooks.

Roelsgaard et al, U.S. Pat. No. 3,239,794, issued Mar. 8, 1966, relates to a retaining device 11 which engages a lead-in unit 4 and receptacle 10. The retaining device is fixed in place between the lead-in unit and the wall (of a capsule). The ends of the retaining device are bent into position by means of pliers to secure the receptacle.

Trunk, U.S. Pat. No. 3,266,655 issued Aug. 16, 1966, discloses two halves of a container for life jackets, secured partially in place with O-ring elements and held firmly, though disengagably, in place with a strap having one end affixed to a ring, the strap encircling the container and passing through the ring. The opposite end of the strap is affixed to the ring, the strap encircling the container at right angles to the aforementioned encircling, passing through the ring. The bight portion of the strap is connected with the adjacent strap portions by Velcro engaging means. A resilient gasket is used to provide a seal for the two halves.

Wallach, U.S. Pat. No. 3,279,008, issued Oct. 18, 1966, discloses two ski bands. One band is a strip of material, such as pigskin, having Velcro hooks at one end and Velcro loops at the opposite end on the opposite surface. A tab is used for disengagement thereof. The other embodiment utilizes a ring 56 in combination with a strip of material having loops and hooks in same surface. Preferably, according to the patent, two strips are utilized for holding a pair of skis together. A good description of a Velcro connector is described in column 2 of Wallach.

Park et al, U.S. Pat. No. 3,327,410, issued June 27, 1967, relates to an athletic shoe with an ankle support. A flexible ankle brace 13 is affixed between the shoe sole 15 and insole 16. A brace extends upward to engage the ankle and the ends are held together by gripping material, fastening and adjusting means, such as is disclosed in U.S. Pat. No. 2,717,437.

Frederick, U.S. Pat. No. 3,489,986, issued Jan. 13, 1970, teaches the securing of connector members by a pair of resilient C or U shaped clamps 74–74, one at either end (see FIG. 6) of a connector 60.

Muckinhaupt, U.S. Pat. No. 3,516,300, issued June 23, 1970, discloses a U shaped cable clamp utilizing a bolt through the two ends of the U shape to adjust and compress the band when positioned in a gripping relationship upon the cable casing.

Waller, Sr., U.S. Pat. No. 3,551,879, issued Dec. 29, 1970, suggests the use of a generally oval elastic band 42 slipped through a slit 40 in a projecting ear of a connector casing which mates with a neck portion of a mating connector casing. Another band is used at the opposite end of the connector casing.

Gley, U.S. Pat. No. 3,575,685, issued Apr. 20, 1971, teaches a latch assembly for engaging and disengaging a multiple contact pin plug assembly with respective receptacles of a friction receptacle assembly. A handle in one assembly operates interengagable means on the assemblies to force pins into frictional engagement.

Moran, U.S. Pat. No. 3,585,569, issued June 15, 1971, teaches the removable contacting of an electrical conductor, such as battery casing, to a conductor 11 via a contact 14 utilizing Velcro hooks 26 affixed to the periphery of conductor 19 and Velcro eyes 25 affixed to the matching periphery of conductor 11. A connector is affixed to a connector panel. The matching connector is held both frictionally and by the Velcro hooks and eyes.

Ray, U.S. Pat. No. 3,640,273, issued Feb. 8, 1972, utilizes a strap assembly having three strap sections, extending from a near common center, for securing a patient's arm to an arm board. One strap section has a slip ring attached to its free end, allowing the free end of the second strap section to be passed through the slip ring. The free ends of the second and third strap sections have a Velcro connection attachment so they can be temporarily connected to each other.

Klotz et al, U.S. Pat. 3,688,348, issued Sept. 5, 1972, refers to Velcro type fasteners, as exemplified in U.S. Pat. No. 3,000,384. The structure, manufacture and use of tape fasteners, as stated in Klotz, are to be found in U.S. Pat. No. 3,009,235. Klotz teaches encircling a pair of socks with hook gender Velcro fastener and joining its end with Velcro loop fastener, so that a pair of socks may be washed and dried, without becoming unmatched in the wash.

Moore, U.S. Pat. No. 3,827,107, issued Aug. 6, 1974, also refers to U.S. Pat. No. 3,009,235. His strap is attached to one portion of a C shaped orthopedic brace or garment. Another portion of the garment carries a buckle through which a strap end may be passed to tighten the garment portions. The strap has both portions of Velcro connectors so that the strap can be releasably locked adjacent the buckle irrespective of the respective portions of the two garment portions.

None of the foregoing patents suggests either a method, device or combination for securing a pair of electrical connectors together by means of fastening members including strips of material having hooks, and strips of material having loops, otherwise known as a Velcro fastener.

It is noted that the term "Velcro", as used hereinabove, is a registered trademark.

None of the foregoing references suggests a novel device for securing connectors together, including a strip of flexible and sturdy material having a slot therein for permitting a cable, or a portion of a connector, to fit therethrough and a pair of mounting holes therein, or similar supporting means, so that such strip can be inserted between a panel member and an electrical connector having corresponding mounting holes. None of the foregoing patents suggests the use of a slit or slits between a mounting hole to a cable slot of the flexible material so that such device could be used in a retrofitting operation.

BRIEF DESCRIPTION OF THE INVENTION

Another object of this invention is to provide a new and improved device for affixing a pair of electrical connectors together, one of such connectors being affixed to a panel member.

Another object of the invention is to provide a new and improved device for securing a pair of electrical connectors together wherein one of the connectors is permanently affixed to a panel board.

Still another object of this invention is to provide a new and improved inexpensive device which is simple to manufacture, and simple to use for securing a pair of electrical connectors together.

Yet still another object of this invention is to provide a new and improved device for securing two electrical connectors together wherein said device can be engaged and disengaged with one hand, without the use of any special tools.

Still another object of this invention is to provide a new and improved means for securing a pair of electrical connectors together, wherein one of said connectors has already been fastened to a panel member, wherein said device can be used in a retrofitting situation.

Another object of the invention is to provide new and improved means for securing a pair of mating electrical connectors together where such securing means is retained by one of the connectors, and where exact alignment is not required between the connectors as heretofore.

Therefore, in accordance with one embodiment of this invention, a device is described for releasably securing a pair of mating electrical connectors together and for retention by one of the connectors when one said connector is retained by a pair of spaced apart supporting surfaces of a supporting member. The one connector includes spaced apart co-planar supporting surfaces for alignment with the supporting surfaces of the supporting member and an intermediate portion with contact terminal members arranged for electrical connection to a multi-conductor cable. The other connector includes a housing member with outer surfaces spaced apart from the one connector. Such a device includes a one piece flexible and sturdy planar member having a pair of spaced apart retention portions to co-align and be positioned between the supporting surfaces of the supporting member and the one connector. An intermediate slot to permit the connection to the cable and a pair of side members integrally and foldably joined to both of the retention portions so that the side members can be folded at right angles to the slot. The side members, when folded, form a U shape and face each other. A first fastening means is carried by one of the side members and a second fastening means is carried by the other of the side members. The first and second fastening means are arranged for cooperation with the housing surfaces of the other connector and with each other to retain the connectors together.

In accordance with another embodiment of the invention, a device is described for securing a pair of mating electrical connectors together wherein one of the electrical connectors has a pair of mounting flange members spaced apart therein for facilitating mounting to a support member having cooperating spaced apart mounting surfaces therein and an intermediate slot to permit electrical connection by an electrical cable to the one electrical connector. Such a device includes a one piece flexible and sturdy planar member having a pair of spaced apart mounting members therein oriented so as to co-align with mounting flange members in the one electrical connector and the support member. The planar member has a cooperating slot therein at least as large as the support member intermediate slot. The one piece planar member is formed so that two substantive portions can be folded at right angles in a U shape along parallel lines extending from opposite sides of the cooperating slot. The portions when folded have inner surfaces facing each other with a space therebetween for housing the other electrical connector. A first fastening surface is carried by the outer surface of one of the portions distant from the slot and a second fastening surface is carried by the inner surface of the other of the portions distant from the slot. The first fastening surface is adapted to engage with the second fastening surface.

In accordance with an embodiment of this invention, a device is described for securing a pair of mating electrical connectors together, wherein one of the electrical connectors has a pair of mounting holes therein which facilitates the mounting to a panel member, the panel member having cooperating mounting holes therein and an intermediate slot to permit the passage of an electrical cable to one of the electrical connectors. Such a device includes a one piece flexible and sturdy planar member which has a pair of mounting holes oriented therein so as to co-align with the mounting holes in the one electrical connector and in the panel member. The planar member has a cooperating rectangular slot therein at least as large as the panel member intermediate slot. The one piece planar member is formed so that two substantive portions can be folded at right angles in a U shape along parallel lines which extend from opposite sides of the rectangular slot. The portions when folded have inner surfaces which face each other with a space therebetween for housing the other electrical connector. A first strip of fastening material is affixed to the outer surface of one of the portions distant from the slot, and a second strip of cooperative fastening material is affixed to the inner surface of the other of the portions distant from the slot. One of the strips contains hook elements, and the other contains loop elements. In accordance with certain features of the invention, the planar member is formed with a slit which extends from one of the mounting holes to an outer edge of the member. The planar member can be formed with a first slit which extends from one of the mounting holes to an outer edge and can be formed with a second slit which extends from the other mounting hole to an outer edge thereof. In accordance with certain features, the slit can extend from one of the mounting holes onto a rectangular slot, and, with other features, can be formed with two slits, one which extends from one of the mounting holes to the slot and the other which extends from the other mounting hole to the slot. In accordance with still other features of the invention, a pair of rigid strips of material can be affixed to the planar member, at the portions, each of the strips having an edge which are aligned along parallel lines.

In accordance with another embodiment of the invention, a device secures a pair of mating electrical connectors together wherein one of the electrical connectors has a pair of mounting holes therein for facilitating mounting to a panel member having cooperating mounting holes therein and an intermediate slot to permit passage of an electrical cable to the aforesaid one electrical connector. Such a device includes a flexible and sturdy planar member having a pair of mounting holes oriented therein so as to co-align with mounting holes in the one electrical connector and in the panel member. The planar member has an opening therein at least as large as the panel member intermediate hole, the planar member being formed so that two substantive portions can be folded at right angles in a U shape along parallel lines which extend along opposite sides of the one connector. The portions when folded have inner surfaces which face each other, with a space therebetween for housing the other electrical connector. A first strip of fastening material is affixed to the outer surface of one of the portions distant from the slot and a second strip of cooperative fastening material is affixed to the inner surface of the other of the portions distant from the slot. One of the strips contains hook elements and the other contains loop elements.

In accordance with yet another embodiment of the invention, a device secures a pair of mating electrical connectors together wherein one of the electrical connectors has a pair of mounting holes therein for facilitating mounting to a panel member having cooperating mounting holes therein and an intermediate slot to permit passage of an electrical cable to the one electrical connector. The device includes a flexible and sturdy planar member having a pair of mounting holes therein oriented so as to co-align with mounting holes in the one electrical connector and the panel member. The planar member has a cooperating rectangular slot therein at least as large as the panel member intermediate slot. The planar member is formed so that two substantive portions can be folded at right angles in a U shape along parallel lines which extend from opposite sides of the rectangular slot. The portions when folded have inner surfaces facing each other with a space therebetween for housing the other electrical connector. A first fastening means is affixed to one of the portions distant from the slot and a second cooperative fastening means is affixed to the other of the portions distant from the slot. In accordance with certain features of the invention, the planar member is formed with a slit extending from one of the mounting holes to an outer edge of the member. In accordance with other features of the invention, the planar member is formed with a first slit extending from one of the mounting holes to an outer edge of the member and is formed with a second slit extending from the other of the mounting holes to an outer edge thereof. In accordance with yet another feature of the invention, the planar member is formed with a slit extending from one of the mounting holes to the rectangular slot, and, with other features of the invention, the planar member can be formed with a first slit extending from one of the mounting holes to the slot and is formed with a second slit extending from the other of the mounting holes to the rectangular slot. In accordance with still other features of the invention, a pair of rigid strips of material can be affixed to the planar member at the portions, each of the strips having an edge aligned along the parallel lines.

In accordance with still yet another embodiment of the invention, a device for securing a pair of mating electrical connectors together, wherein one of the electrical connectors has a pair of mounting holes therein which facilitates mounting to a panel member having cooperating mounting holes therein and an intermediate slot to permit passage of an electrical cable to the one electrical connector, such a device can include a flexible and sturdy planar member having a pair of mounting holes therein oriented so as to co-align with the mounting holes in the one electrical connector and in the panel member. The planar member has an opening therein at least as large as the panel member intermediate slot. The planar member is formed so that two substantive portions can be folded at right angle in a U shape along parallel lines which extend along opposite sides of the connector. The portions when folded have inner surfaces facing each other with a space therebetween for housing the other electrical connector. A first fastening means is affixed to one of the portions distant from the slot and a second cooperative fastening means is affixed to the other of the portions distant from the slot.

In accordance with certain embodiments of the invention, combinations can be formed such as a combination including a first electrical connector having a pair of mounting holes therein and a panel having cooperating mounting holes therein and an intermediate slot to permit passage of an electrical cable therethrough to the first connector. A second electrical connector has a right angle shape and is adpated to mate with the first connector. A flexible and sturdy planar member has a pair of mounting holes therein oriented so as to co-align with the mounting holes in the first connector on the panel. The planar member has a cooperative rectangular slot therein at least as large as the panel member intermediate slot.

The planar member is formed so that two substantive portions can be folded at right angles in a U shape, along parallel lines extending from opposite sides of the rectangular slot. The portions, when folded, have inner surfaces facing each other with a space therebetween for housing the other electrical connector. A first strip of fastening material is affixed to the outer surface of one of the portions distant from the slot; a second strip of cooperative fastening materials is affixed to the inner surface of the other portions distant from the slot. One of the strips contains hook elements and the other strip contains loop elements. A pair of mounting bolts fastens the first connector, the planar member, and the panel, in the order named, whereby portions of the planar member extend outwardly away from the panel, the bolts being inserted in the mounting holes.

In accordance with another embodiment of the invention, a combination can be provided which includes a first electrical connector which has a pair of mounting holes therein. A panel has cooperating mounting holes therein and an intermediate slot to permit passage of an electrical cable therethrough to the first connector. A second electrical connector is provided which has a right angle shape and is adapted to mate with the first connector. Also provided is a flexible and sturdy planar member having a pair of mounting holes oriented therein so as to co-align with mounting holes in the first connector and the panel. The planar member has a cooperating rectangular slot therein at least as large as the panel member intermediate slot. The planar member is formed so that two substantive portions can be folded at right angles in a U shape along parallel lines extending from opposite sides of the rectangular slot. The portions, when folded, have inner surfaces facing each other with a space therebetween for housing the second electrical connector. A first fastening means is affixed to one of the portions distant from the slot, and a second cooperative fastening means is affixed to the other of the portions distant from the slot. In accordance with certain features of the invention, the combination is such that the planar member is formed with a slit extending from one of the mounting holes to an outer edge of the member. In accordance with other features, the planar member can be formed with a first slit extending from one of the mounting holes to an outer edge and can be formed with a second slit extending from the other of the mounting holes to an outer edge of the member. In accordance with still other features, the combination can be such that the planar member is formed with the slit extending from one of the mounting holes to the rectangular slot, and, the planar member, in another version, can be formed with a first slit extending from one of the mounting holes to the rectangular slot and can be formed with a second slit extending from the other of the mounting holes to the rectangular slot. In accordance with still another feature of the invention, the combination can include a pair of rigid strips of material affixed to the planar member at the portions, each of the strips having an edge aligned along parallel lines.

In accordance with still another embodiment of the invention, a novel combination can include a first electrical connector having a pair of mounting holes therein. A panel has cooperating mounting holes therein and an intermediate slot to permit passage of an electrical cable therethrough to the first connector. A second electrical connector is provided which has a right angle shape and is adapted to mate with the first connector. A flexible and sturdy planar member has a pair of mounting holes therein oriented so as to co-align with mounting holes in the first connector and the panel. The planar member has an opening therein at least as large as the panel member intermediate slot. The planar member is formed so that two substantive portions can be folded at right angles in a U shape along parallel lines which extend along opposite sides of the rectangular slot. The portions when folded have inner surfaces facing each other, with a space therebetween for housing the second electrical connector. A first fastening means is affixed to one of the portions distant from the slot. A second cooperative fastening means is affixed to the other of the portions distant from the slot. Further, a pair of mounting bolts fasten the first connector, the planar member, and the panel, in the order named, so that portions of the planar member extend outwardly away from the panel, the bolts being inserted into the mounting holes.

In accordance with another embodiment of the invention, a device is described which secures a pair of mating electrical connectors together wherein one of the electrical connectors has a pair of mounting holes therein for facilitating mounting to a panel member having cooperating mounting holes therein and an intermediate slot to permit the passage of an electrical cable to the one electrical connector, and wherein the other electrical connector has a first strip of fastening material affixed to one side thereof and has a second strip of fastening material affixed to the opposite side thereof. Such a device includes a one piece flexible and sturdy planar member having a pair of mounting holes therein oriented so as to co-align with mounting holes in the one electrical connector and in the panel member. The planar member has a cooperating rectangular slot therein which is at least as large as the panel member intermediate slot. The one piece planar member is so formed so that two substantive portions can be folded at right angles in a U shape along parallel lines which extend from opposite sides of the rectangular slot. The portions when folded have inner surfaces which face each other, with a space therebetween for housing the other electrical connector. A third strip of fastening material is affixed to the inner surface of one of the portions distant from the slot, one of the first and third strips contains hook elements, the other contains loop elements. A fourth strip of fastening material is affixed to the inner surface of the other of the portions distant from the slot. One of the second and fourth strips contain hook elements, the other one contains loop elements.

In accordance with still yet other embodiments of the invention, novel methods are provided, one of the methods including that of assuring the securing of a pair of mating electrical connectors together, wherein one of the electrical connectors have a pair of mounting holes therein for facilitating mounting to a panel member having cooperating mounting holes therein and an intermediate slot to permit passage of an electrical cable to the one electrical connector. Such a method includes the following steps: First, providing a flexible and sturdy planar member having a pair of mounting holes therein oriented so as to co-align with mounting holes in the one electrical connector and in the panel member. The planar member has a cooperating rectangular slot therein at least as large as the panel member intermediate slot. The planar member is formed so that two substantive portions can be folded at right angles in a U shape along parallel lines which extend from opposite sites of the rectangular slot. The portions when folded have inner surfaces which face each other with a space therebetween for housing the other electrical connector. A first strip of fastening material is affixed to the outer surface of one of the portions distant from the slot and a second strip of cooperative fastening material is affixed to the inner surface of the other of the portions distant from the slot. One of the strips contains hook elements. The other contains loop elements. Then, the planar member is placed onto the panel member so that the mounting holes of one of the members are co-aligned, the member being so oriented so that when folded, the inner surfaces of the portions face each other. Next, the one electrical connector is placed onto the planar member so that the mounting holes are co-aligned and, finally, the one electrical connector, the planar member, and the panel member are fastened together at the mounting holes. In accordance with certain features of the invention, the method can further include affixing a cable to the one electrical connector. In accordance with still another feature of the invention, the method can include the folding of the portions of planar member outwardly away from the panel member; then, wrapping one portion of the planar member about the other connector in an intimate manner; and finally, coupling the other portion of the planar member about the other connector and the one portion so that the fastening materials interengage so that the connectors are secured.

In still yet another embodiment of the invention, a method is provided for securing a pair of mating electrical connectors together wherein one of the electrical connectors has a pair of mounting holes therein mounted by bolts to a panel member having corresponding cooperating mounting holes therein. The panel member has an intermediate slot for permitting an electrical cable affixed to one of the connectors to pass therethrough. The method utilizes a flexible and sturdy planar member having a pair of mounting holes therein oriented so as to co-align with mounting holes in the one electrical connector and in the panel member. The planar member has a cooperating rectangular slot therein at least as large as the planar member intermediate slot. The planar member is formed so that the two substantive portions can be folded at right angles in a U shape along parallel lines extending from opposite sides of the rectangular slot. The portions, when folded, have inner surfaces facing each other with a space therebetween for housing the other electrical connector. A first strip of fastening material is affixed to the outer surface of one of the portions distant from the slot, and a second strip of cooperating fastening material is affixed to the inner surface of the other of the portions distant from the slot. One of the strips contains hook elements and the other contains loop elements. The planar member is formed with a slit extending from one of the mounting holes to the rectangular slot. The method comprises the following steps: First, one of the bolts is disengaged at one set of the aligned mounting holes. Then, the planar member is positioned so that the other of the planar member mounting holes is oriented between the one connector and the panel member with the mounting holes co-aligned. Next, said one of the bolts is engaged at the aligned mounting holes of the first connector, the planar member, and the panel member. The other of the bolts is then loosened. Then, the one mounting hole of the planar member is positioned above the other bolt which engages the remaining set of aligned mounting holes. The planar member is then bent and manipulated at both sides of the slit at the one mounting hole so that the planar member at the slit, at the one mounting hole, and at portions between the parallel lines, is located between the one connector and the panel member. Finally, the other bolt is tightened. In accordance with certain features of the invention, the portions of the planar member can be folded outwardly away from the panel member and then, the one portion of the planar member is wrapped about the other connector in an intimate manner. Finally, the other portion of the planar member is coupled about the other connector and the one portion so that the fastening materials interengage so that the connectors are secured.

In accordance with still yet another embodiment of the invention, a novel method is described for securing a pair of mating electrical connectors together wherein one of the electrical connectors has a pair of mounting holes therein, mounted by bolts to a panel member which has corresponding cooperating mounting holes therein. The panel member has an intermediate slot for permitting an electrical cable affixed to the one connector to pass therethrough. The method utilizes a flexible and sturdy planar member which has a pair of mounting holes therein so oriented so as to co-align with mounting holes in the one electrical connector and in the panel member. The planar member has a cooperating rectangular slot therein which is at least as large as the planar member intermediate slot. The planar method is formed so that two substantive portions can be folded at right angles in a U shape along parallel lines which extend from opposite sides of the rectangular slot. The portions when folded have inner surfaces which face each other with a space therebetween for housing the other electrical connector. A first strip of fastening material affixed to the outer surface of one of the portions is distant from the slot, and a second strip of cooperative fastening material is affixed to the inner surface of the other of the portions which is distant from the slot. One of the strips contains hook elements. The other contains loop elements. The planar member is formed with a slit which extends from one of the mounting holes to the rectangular slot and is formed with a second slit which extends from the other of the mounting holes to the rectangular slot. The method comprises the following steps: First, the planar member is placed onto the connector so that the mounting holes are approximately co-aligned. Then, the planar member is slid along a line which joins the two sets of mounting holes in a first direction. Then, the relatively free end of the planar member is bent and manipulated at positions adjacent to one of the slits so that the portions adjacent to the one slit becomes engaged between the first connector and the panel member. Then, the planar member is slid in a direction opposite to the first direction, following which, the disengaged end of the planar member is bent and manipulated at portions adjacent to the other of the slits so that the portions adjacent to the other slit becomes engaged between the first connector and the panel member. Finally, the planar member is adjusted and centered so that the planar member nests smoothly between the one connector and the panel so that the mounting holes are generally co-aligned.

BRIEF DESCRIPTION OF THE DRAWINGS

Other objects, advantages, and features of this invention will become more apparent from the following description when read in conjunction with the accompanying drawing, in which:

FIG. 3 is a top view of a cable connector hold-down device in accordance with one embodiment of the invention;

FIG. 3*a* is a fragmentary view of an alternate embodiment for the hold down device of FIG. 3 in which slots from the mounting holes extend outwardly.

FIG. 4 is a bottom view thereof;

FIG. 5 is a front view thereof;

GENERAL DESCRIPTION

Figure 1:
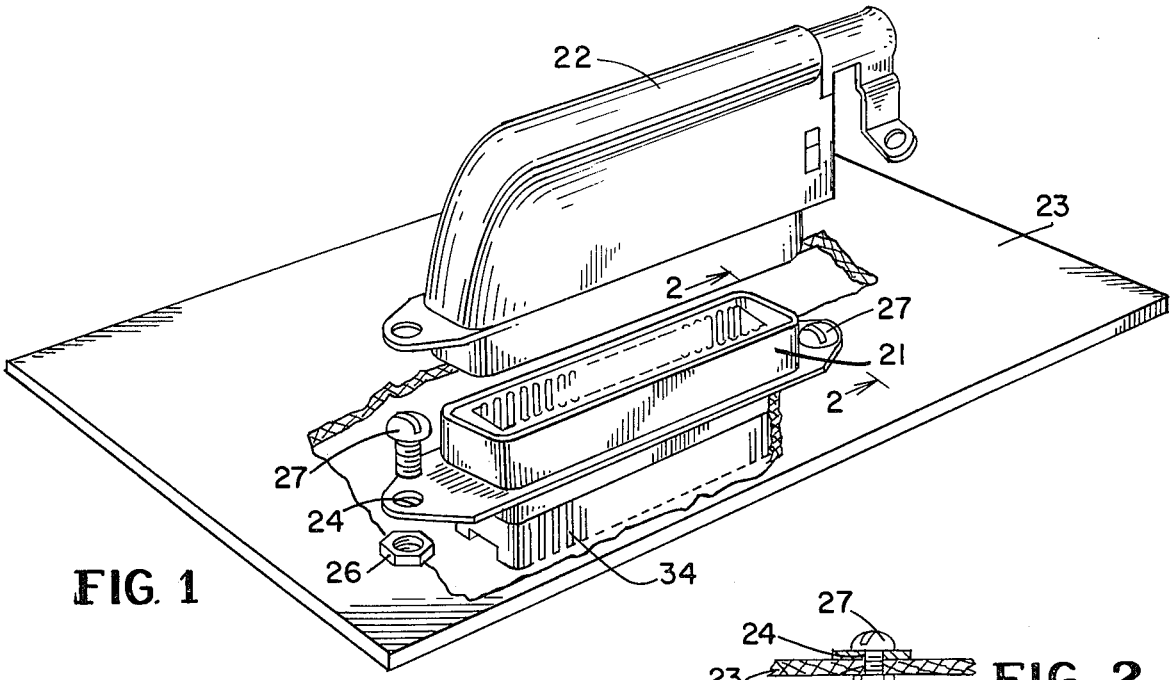
FIG. 1 is a perspective view of a pair of prior art cable connectors, one of which is bolted to a panel substrate in accordance with known prior art techniques.
Figure 2:
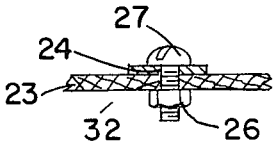
FIG. 2 is a sectional view taken along the lines 2—2 of FIG. 1.

Referring to FIG. 1, there is shown a perspective view, partly in section, of a pair of prior art mating electrical connectors, one of which is affixed to a panel substrate. The cable connectors may be, for example, that type designated as a 57 series by the Amphenol Division of Bunker Ramo Corporation. The particular connectors illustrated in FIG. 1 are of the cable to panel type, wherein the cable type shown is that termed a low profile hood type. The panel type connector shown at FIG. 1 is affixed by a panel by means of mounting holes via suitable means which may include a nut and a bolt which is a preferred mode, or may include a screw which screws the panel connector into the substrate, or alternatively can include a rivet. Other connector means are, of course, possible, though not normally preferred, such as cotter pins, for example. FIG. 2 is a cross-sectional view taken along the line 2—2 of FIG. 1 which illustrates the panel connector connected to the panel by a suitable nut and bolt.

DESCRIPTION OF A PREFERRED EMBODIMENT

Figure 6:
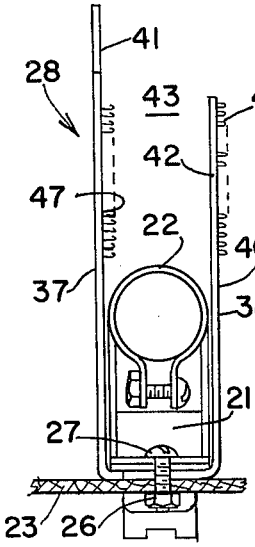
FIG. 6 is a side view, partly in section, illustrating the cable connector hold-down device of FIGS. 3 to 5 in cooperation with a pair of mating electrical connectors, with the hold-down device shown in an open condition.
Figure 7:
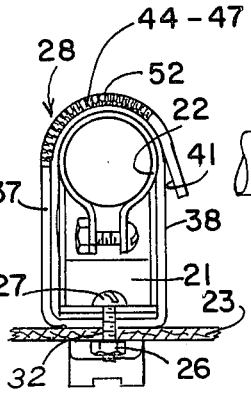
FIG. 7 is a side view of the combination shown in FIG. 6 with the cable connector hold-down device closed and engaged.
Figure 8:
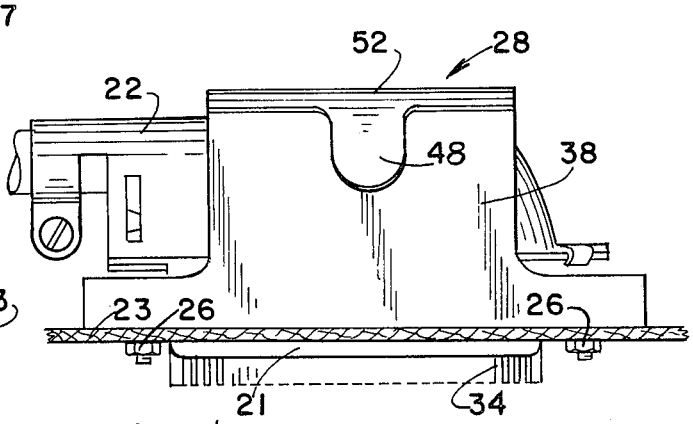
FIG. 8 is a front view thereof.

Referring to FIGS. 3, 4, and 5, there is shown a securing device 28 for securing a pair of connectors 21, 22 together (see FIGS. 6, 7, and 8). The securing device 28 is formed of a one piece flexible and sturdy planar member 29 which planar member is relatively flexible and sturdy. Various materials are suitable for this purpose, one of which would include polypropylene, the preferred substrate contemplated by the inventor. The member 29 can be formed by stamping, injection molding, or by extrusion. A thickness of 0.020 inch is suitable. Other thicknesses, such as 0.015 inch are believed acceptable. Depending upon material and type of forming, a range of 0.010 to 0.030 inch is practical.

The planar member 29 has a pair of mounting holes 31—31 which are oriented thereon so as to co-align with the corresponding mounting holes 24–24 in the panel connector 22 and with the mounting hole 32 in the panel member 23.

The planar member 29 has a rectangular slot 33 formed therewithin, such slot 33 being of sufficient size so that the base 34 of the panel connector 21 can fit therethrough and, for similar reasons, the rectangular slot 33 of the planar member 29 is at least as large as an intermediate slot (not shown) of the panel member 23.

The planar member 29 is formed, as by scoring at 36—36, so that two substantive portions 37, 38 can be folded at right angles in a U shape (see FIG. 6) along parallel lines *a—a* and *b—b* extending from opposite sides of the rectangular slot 33. The portions, 37, 38, when folded, have inner surfaces 41, 42, respectively, which face each other with a space 43 therebetween for housing the cable connector 22, as shown clearly in FIG. 6.

Referring to FIG. 4, a first strip of fastening material 44 is affixed to the outer surface 46 of the portion 38. The fastening material 44 is affixed thereto distant from the slot 33. A second strip of cooperative fastening material 47 is affixed to the inner surface 41 of the portion 37 distant from the slot 33. One of the strips 44, 47 contains hook elements and the other contains loop elements.

The strips of fastening material containing either minute hooks or loops, are preferably material known as VELCRO. As shown, the strip 44 contains loops, generally in the form of intertangled fibers adhered to a cloth ribbon. The strip 47 of fastener material contains the hooks for engagement with the loops. Such hooks are commonly formed by splitting relatively rigid elongated but tiny plastic loops at the outer ends thereof adjacent to the bight so that, when pressed into the intertangled loop containing fibers in the strip 44, the hooks catch in the loops. Due to the great number of hooks and loops, the engagement forms a secure connection having tremendous tenacity against shear, i.e., in the direction co-planar of material to prevent accidental disengagement therebetween. As is known, however, the materials can be separated readily when the one in pulled in a direction normal to the other. The strip 47 is terminated short of the actual end to leave a definite and necessary tab 48 at this end of the band. The strip 47 is normally, also somewhat shorter in width than the strip 44 for optimum engagement in the overlapping area when the device is being used.

The fastening material is sometimes sold in tape form as a tape fastener under the trademark "VELCRO" which has received wide usage as fastening straps as exemplified in U.S. Pat. No. 3,000,384 and as clothing fasteners. They use two mating strips of fabric tape; one of which has been referred to as a "hook gender" tape, which has an operative surface bristling with a multitude of small upstanding monofilament hooks and the other, sometimes referred to as "loop gender" tape, has an operative surface faced with a napped pile of fine thread. When the two tapes are brought together, the hooks embed themselves in the pile, engaging the loops of thread to provide a fastener capable of withstanding shear forces as great as 20 pounds per square inch. Yet, the tapes separate easily when peeled apart. Moreover, they can be subjected to opening and closing cycles repeatedly without loss of strength or sign of wear. A more thorough exposition of the structure, manufacture, and use of tape fasteners is found in U.S. Pat. No. 3,009,235.

The planar member 29 is further provided with slits 49—49 which extend from the mounting holes 31—31 to an outer edge of the planar member 29. More specifically, and preferably, the slits extend from the mounting holes 31—31 to the rectangular slot 33.

In one form of operation, the planar member 29 is placed directly on the panel member 23 so that the mounting holes 31—31 coincide, or are aligned, with the mounting holes 32—32 of the panel substrate 23. The planar member 29 is so oriented so that, when folded, the inner surfaces 41, 42 of the portions 37, 38 face each other. Then, the panel connector 21 is placed onto the planar member 29 so that the mounting holes 24—24 of the panel connector 21 are co-aligned with the mounting holes 31—31 of the planar member 29 and the mounting holes 32—32 of the panel substrate 23. Then, the electrical connector 21, planar member 29 and the panel substrate 23 are fastened together at the mounting holes by suitable means as by a nut 26 and bolt 27.

Following the coupling of the panel connector 21, the securing device 28, and the panel substrate 23 together, a cable can then be affixed to the electrical connector 21 in known fashion.

To assure proper electrical connection and to secure the same, the cable connector 22 can be inserted into the panel connector 21 or visa versa so that they mate in intimate electrical contact. The portions 37, 38 are folded outwardly away from the panel member 23, as shown in FIG. 6. As shown in FIG. 7, the portion 38 of the securing device 28 is wrapped about the cable connector 22 in an intimate manner. Then, the other portion 37 of the planar member 29 is coupled about the connector 22 and the portion 38 so that the fastening materials 44, 47 interengage whereby the connectors 21 and 22 are secured as depicted in FIGS. 7 and 8.

The surface 42 of the planar member 29, opposite the strip of fastening material 44, can have a plurality of scoring 51, preferably lengthwise, in order to provide for increased flexibility at that portion of the planar member 29. Such scoring can be spaced, for example, ⅛ inch apart. Similarly, on the opposite surface, there is a plurality of scoring 52, opposite fastening material 47, to also provide for increase in flexibility. The fastening material 44, 47 can be affixed to the planar member by known methods, such as by adhesive.

DESCRIPTION OF ANOTHER EMBODIMENT

Figure 9:
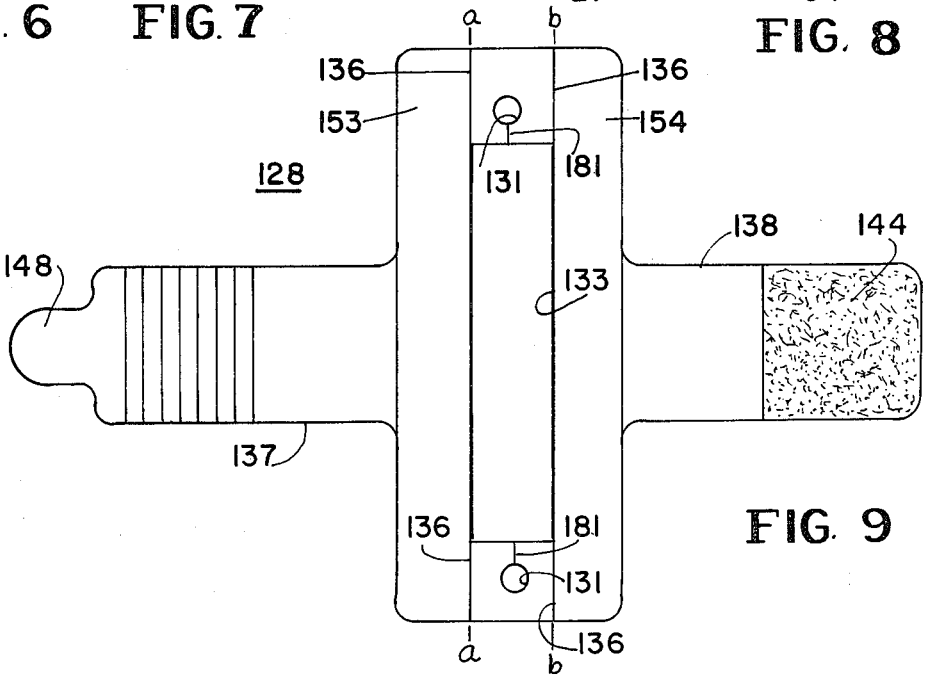
FIG. 9 is a bottom view of another embodiment of the invention.
Figure 10:
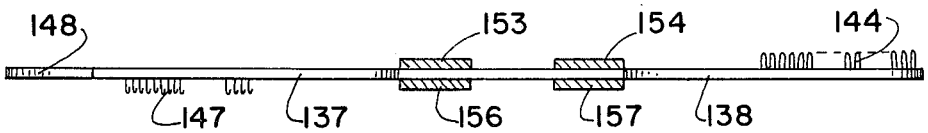
FIG. 10 is a front view of the embodiment shown in FIG. 9.
Figure 11:
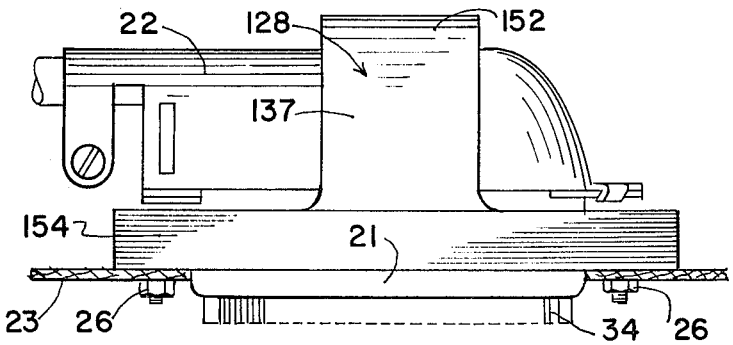
FIG. 11 is a front view of a combination including the embodiment shown in FIGS. 9 and 10 in cooperation with a pair of cable connectors in the engaged position, such view being somewhat similar to that shown in FIG. 8.

Referring to FIGS. 9, 10, and 11, there is shown another securing device 128.

FIGS. 9, 10, and 11 contain reference numerals similar to, but designated with reference numerals 100 higher than, those shown in FIGS. 1 through 7. For example, the tab of the securing device is designated with the reference numeral 148. The securing device 128, shown in FIG. 9, differs somewhat from the embodiment depicted in FIGS. 3 and 4 by the addition of strips of rigid material 153, 154 which are affixed to the planar member 148 at the portions 137, 138. Optionally, a pair of rigid strips of material 156, 157 can be affixed to the opposite surface of the planar member 129 so as to provide for greater strength. The affixation of the rigid strips 153, 154, 156, 157 to the planar member 129 can be done by any of various known techniques including adhesive, rivetting and the like. A cross-sectional view is depicted in FIG. 10 and a top view is shown in FIG. 9. FIG. 11 shows the securing device 128 in operation securing the cable connector 22 to a panel connector 23. The rigid strips assure that the material of the member 129 does not bend or buckle or become unsightly and provides great rigidity where it is most desired, namely, down near the base near the panel substrate 23 so as to provide for reasonable strength. The rigid strips, however, can be of any type of material. They may be metal or plastic so long as they maintain rigidity.

DESCRIPTION OF ANOTHER EMBODIMENT

Figure 12:
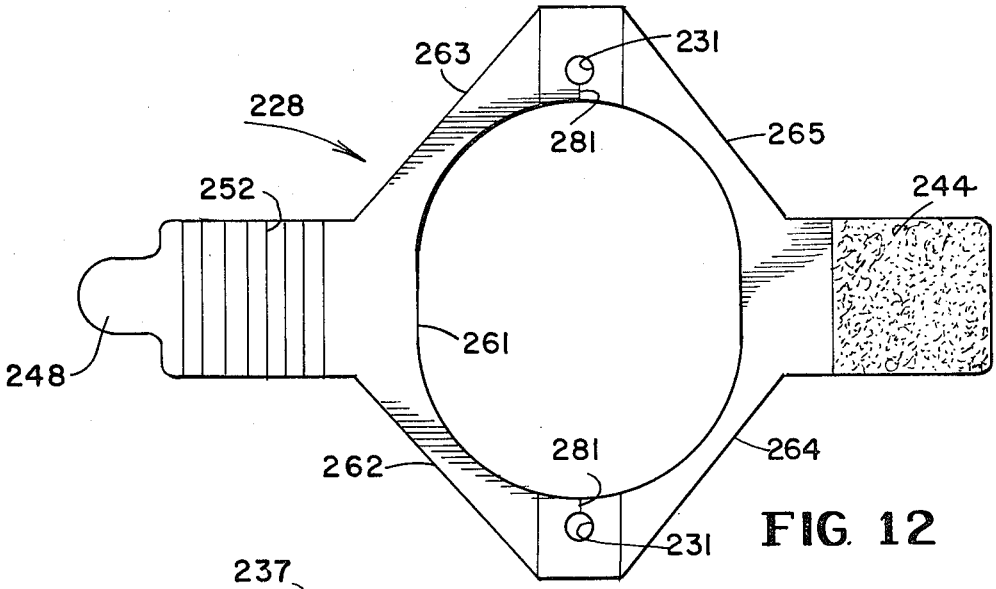
FIG. 12 is a bottom view of still another embodiment of the invention.
Figure 13:
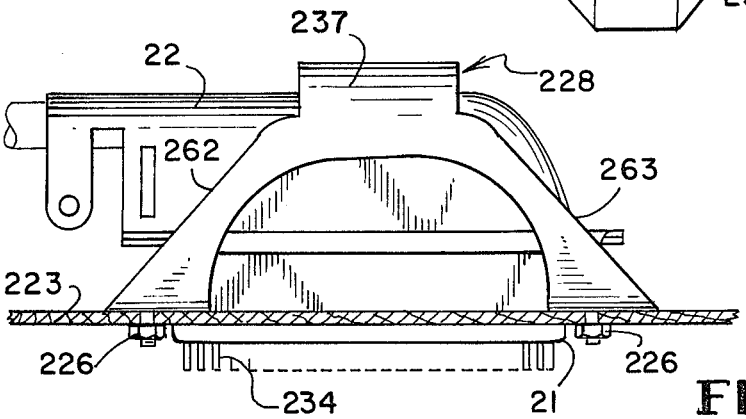
FIG. 13 is a front view of a combination including the device shown in FIG. 12 in cooperation with a pair of cable connectors, somewhat similar to the combinations shown in FIGS. 8 and 11.

Another version of the invention relates to a device for securing electrical connectors, such as the device 228 illustrated in FIGS. 12 and 13. The device 228 is constructed in somewhat similar fashion to the securing device depicted in FIGS. 3 and 4. FIGS. 12 and 13 contain reference numerals designated 200 higher than corresponding elements shown in FIGS. 3 and 4. Thus, for example, the tab with the securing device 228 is designated with a reference numeral 248.

The securing device depicted in FIG. 12 does not have a rectangular slot, but, instead, has a much larger opening 261. The opening 261, generally, is as long as the rectangular slot 33 of the securing device 28; however, instead of being rectangular, it is generally oval in shape and has a much larger cross-section, as far as the opening is concerned. As shown in FIG. 13, the device 228 does not grip the sides of the connector 21 or 22 in its entirety, but, instead, apparently, appears bifurcated in a folded condition, having a pair of legs 262 and 263 along one side of the engaged securing device. On the opposite side are a pair of legs 264 and 265 (not shown in FIG. 13, but is shown in FIG. 12). FIG. 12 shows that, in fact, the various portions are not bifurcated but merely appear so when in the folded condition. The advantage of the device shown in FIGS. 12 and 13 is that less material is needed; less polypropylene is used if such is the plastic desired, without departing from the goal of engaging and securing the two electrical connectors 21, 22. No buckling appears along the sides of the panel connector 21 as it engages the panel substrate 23 for one main reason: Namely, there is no material there due to the large gap provided by the hole or opening 261.

DESCRIPTION OF YET ANOTHER EMBODIMENT

Figure 14:
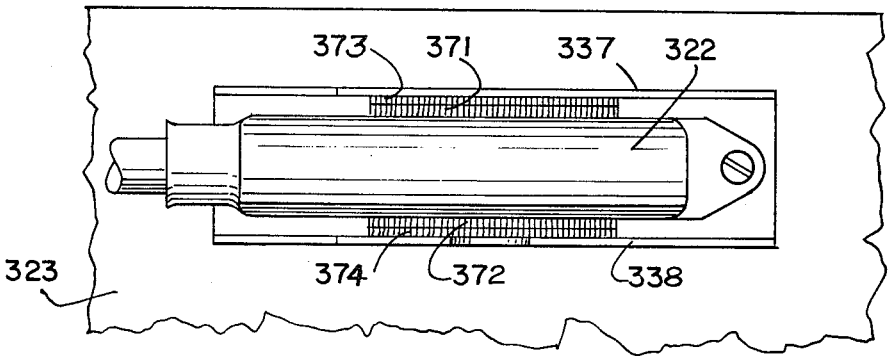
FIGS. 14, 15 and 16 are top, front, and end views, respectably, of yet another embodiment of this invention.
Figure 15:
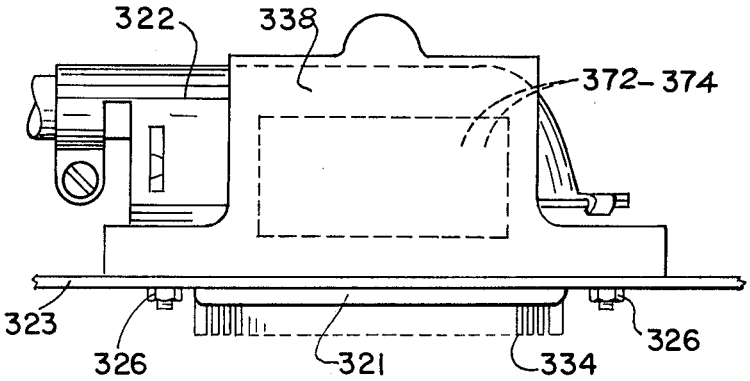
Figure 16:
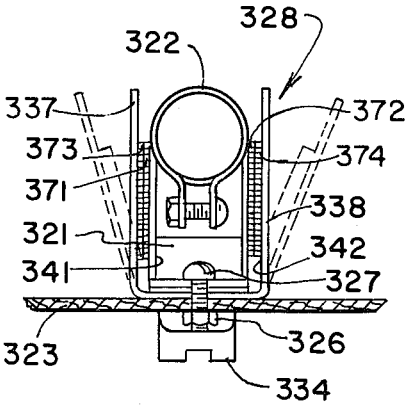

Referring to FIGS. 14, 15, and 16, there is depicted yet another embodiment of the invention. As most clearly illustrated in FIG. 16, the cable connector 322 is provided with a strip of fastening material 371, 372 on opposite sides thereof. The cable connector 322 engages and mates with a corresponding panel connector 321 which is adapted to be affixed to a panel substrate 323 by suitable means, as by a nut 326 and a bolt 327. A securing device 328 has a pair of substantive portions 337 and 338 which fold upward in a U shape, away from the base similar to that heretofore. However, the inner surfaces of the portions 337 and 338 have strips of fastening material 373 and 374 affixed thereto.

The strips of fastening material 371 and 373 are of opposite gender. Likewise, the strips of fastening material 372 and 374 are of opposite gender. By that is meant: one gender are strips containing hook elements, while the other gender are strips containing loop elements, so that a strip containing hook elements intergages with a strip containing loop elements. FIG. 16 depicts, in dotted outline, the unfolded condition or the disengaged or unsecured condition of the securing device 328 in dotted outline. The solid outline shows the device secured and engaged. As described hereinabove in connection with the other securing devices, the securing device 328 has mounting holes and a rectangular slot therein (not shown for simplicity of the illustration and description).

IN GENERAL

By means of this invention, a universal connector hold-down is provided that can be used on various types of connectors without the use of special tools such as pliers and the like. The securing device can be simply and conveniently manufactured by known stamping or injection molding techniques where polypropylene is the material. The securing device can be constructed of other plastics such as polyurethane and polyethylene by known techniques. The thickness of this material can range over a comparatively wide range. The securing device can be assembled between the panel connector and the panel member. It can be held in place by connector mounting screws. A rectangular opening is provided in the securing device with the wire termination end of the connector to extend therethrough, and four plastic hinge areas are provided via the grooves 36—36, permitting the planar member to bend perpendicular to the panel. The parts extend upwards from the panel with fastening devices, preferably the hook and loop type fasteners, which are commonly sold under the tradename, VELCRO and are also commercially available under the tradename, SCOTCHMATE. The hook and loop fasteners are bonded in such a manner that they overlap over the connector hook so as to interlock. A convenient finger tab 48 is provided for easy removal.

This invention does not require the use of special tools for its operation. The securing device can be used on various sizes of connectors, shapes, and materials, and does not depend on any accurate mechanical alignment of the parts, due to the inherent nature of the loop and hook type fasteners. The VELCRO or SCOTCHMATE hook or loop fastener can be affixed to the polypropylene base with a pressure sensitive or solvent activated adhesive backing.

In a preferred form, each of the connectors has slits 81—81 extending from the mounting holes 31—31 to the rectangular slot 33. By means of such a slit 81, a retrofitting operation can be easily performed. For example, one method secures a pair of mating electrical connectors 21, 22 together, wherein one of the electrical connectors 21 has a pair of mounting holes 24—24 therein mounted by bolts 27—27 to a panel member 23 which has cooperating mounting holes 32—32 therein. The panel member has an intermediate slot for permitting an electrical cable affixed to the panel connector 21 to pass therethrough. The method utilizes a flexible and sturdy planar member 29 which has a pair of mounting holes 31—31 therein so as to co-align with mounting holes in the panel connector 21 and the panel member 23. The planar member 29 has a cooperating rectangular slot 22 therein at least as large as the panel member intermediate slot. The planar member 29 is formed so that the two substantive portions 37, 38 can be folded at right angles in a U shape along parallel lines a—a and b—b which extend from opposite sides of the rectangular slot 33. The portions 37, 38, when folded, have inner surfaces 41, 42 which face each other with a space 43 therebetween for housing the other electrical connector 22. A strip of fastening material 44 is affixed to the outer surface 46 of one of the portions and a strip of cooperating fastening material 47 is affixed to the other of the portions distant from the slot. One of the strips contains hook elements and the other strip contains loop elements. The planar member is formed with a slit 81 extending from one of the mounting holes to the rectangular slot. The foregoing method involves the following steps: First, disengaging one of the bolts 27 at one set of aligned mounting holes. Next, positioning the planar member, so that the other of the planar member mounting holes is oriented between the one connector and the panel member with the mounting holes co-aligned. Then, one of the bolts is engaged at the aligned mounting holes of the first connector, the planar member and the panel member. The other bolt is loosened. The one mounting hole of the planar member is positioned above the other bolt which engages the remaining set of aligned mounting holes. Then, the planar member is bent and manipulated at both sides of the slit at the mounting hole so that the planar member at the slit at such mounting hole and at portions between parallel lines is located between the one connector and the panel member. Then, the other bolt is tightened.

Subsequently, portions of the planar member can be folded upwardly away from the panel member, and one portion of the planar member is wrapped about the other connector in an intimate manner so that the other portion of the planar member can be coupled about the other connector and the one portion so that the fastening materials interengage so that the connectors are secured.

It is preferable that there be two slits: one set on each side for each mounting hole. Thus, each mounting hole 36 has a slit 81 going to the rectangular slot 33 of the securing device 28. Such is ideal for a retrofitting operation, where a panel connector may be mounted to a panel substrate by means such as rivets or by nuts and bolts which may be difficult to undo. Thus, such a method retrofits a panel connector which is already affixed to a substrate, and secures a pair of mating electrical connectors together, wherein one of the electrical connectors 21 has a pair of mounting holes therein mounted by bolts to a panel member having corresponding cooperating mounting holes. The panel member has an intermediate slot for permitting an electrical cable affixed to the one connector to pass therethrough. The method utilizes a flexible and sturdy planar member having a pair of mounting holes therein oriented so as to co-align with mounting holes in the one electrical connector and said panel member. The planar member has a cooperating rectangular slot therein at least as large as the planar member intermediate slot. The one piece planar member is formed so that two substantive portions can be folded at right angles in a U shape along parallel lines *a—a* and *b—b* extending from opposite sides of the rectangular slot. The portions, when folded, have inner surfaces which face each other with a spcae therebetween for housing the other electrical connector. A first strip of fastening material is affixed to the outer surface of one of the portions distant from the slot, and a second strip of cooperating fastening material is affixed to the inner surface of the other said portions distant from said slot. One of the strips contains hook elements and the other strip contains loop elements. The planar member is formed with a first slit extending from one of the mounting holes to the rectangular slot, and is formed with a second slit extending from the other of the mounting holes to the rectangular slot. The foregoing method comprises the following steps: The planar member is placed onto the panel connector so that the mounting holes are approximately co-aligned. Then, the planar member is slid along the line joining the two sets of mounting holes in a first direction. Following that, the relatively free end of the planar member is bent and manipulated at positions adjacent to one of the slits, so that the portions adjacent to the one slit becomes engaged between the panel connector and the panel substrate. Then, the planar member is slid in a direction opposite to the first direction. Following that, the disengaged end of the planar member is bent and manipulated at portions adjacent to the other of the slits, so that the portions adjacent to the other slit becomes engaged between the panel connector and the panel member. Then, the planar member is adjusted and centered so that the planar member nests smoothly between the panel connector and the panel, wherein the mounting holes are generally co-aligned.

As shown in FIG. 3*a*, in an alternative embodiment, the slits 81a may extend from one or both of the mounting holes 31 to an outer edge of the planar member 29.

CONCLUSION

Other embodiments will suggest themselves to those ordinarily skilled in the art, without departing from the spirit and scope of this invention. Certain terminology may appear in the claims which are meant to have a broadening scope and are not meant to be limiting. For example, the term "bolt" is used in a very broad context and is meant to include such connectors as rivets and the like. Further, securing devices, in accordance with the invention, can be used in various electrical environments, such as in bridging adapters. Other embodiments of a securing device would include devices for holding various different shapes of connectors, such as straight or side entry types.

What is claimed is:

1. A device for releasably securing a pair of mating electrical connectors together and for retention by one of the connectors when said one connector is retained by a pair of spaced apart supporting surfaces of a supporting member, the one connector including spaced apart co-planar supporting surfaces for alignment with the supporting surfaces of said supporting member and an intermediate portion with contact terminal members arranged for electrical connection to a multiconductor cable, the other connector including a housing member with outer surfaces spaced apart from said one connector, said device comprising a. a one piece flexible and sturdy planar member having a pair of spaced apart retention portions to co-align and be positioned between the supporting surfaces of the supporting member and one connector, an intermediate slot to permit said connection to said cable, and a pair of side members integrally and foldably joined to both of said retention portions so that said side members can be folded at right angles to said slot, said side members when folded forming a U shape and facing each other, b. a first fastening means carried by one of the side members, and c. a second fastening means carried by the other of the side members, the first and second fastening means being arranged for cooperation with the housing surfaces of the other connector and with each other to retain the connectors together.

2. A device for securing a pair of mating electrical connectors together, wherein one of said electrical connectors has a pair of mounting flange members spaced apart therein for facilitating mounting to a support member having cooperating spaced apart mounting surfaces therein and an intermediate slot to permit electrical connection by an electrical cable to said one electrical connector, said device comprising a. a one piece flexible and sturdy planar member having a pair of spaced apart mounting members therein oriented so as to co-align with mounting flange members in said one electrical connector and said support member, said planar member having a cooperating slot therein at least as large as said support member intermediate slot, said one piece planar member being formed so that two substantive portions can be folded at right angles in a U-shape along parallel lines extending from opposite sides of said co-operating slot, said portions when folded having inner surfaces facing each other with a space therebetween for housing the other electrical connector;

b. a first fastening surface carried by the outer surface of one of said portions distant from said slot; and c. a second fastening surface carried by the inner surface of the other of said portions distant from said slot, said first fastening surface being adapted to engage with said second fastening surface.

3. A device for securing a pair of mating electrical connectors together, wherein one of said electrical connectors has a pair of mounting holes therein for facilitating mounting to a panel member having cooperating mounting holes therein and an intermediate slot to permit passage of an electrical cable to said one electrical connector, said device comprising 1. a one piece flexible and sturdy planar member having a pair of mounting holes therein oriented so as to co-align with mounting holes in said one electrical connector and said panel member, said planar member having a cooperating rectangular slot therein at least as large as said panel member intermediate slot, said one piece planar member being formed so that two substantive portions can be folded at right angles in a U shape along parallel lines extending from opposite sides of said rectangular slot, said portions when folded having inner surfaces facing each other with a space therebetween for housing the other electrical connector;

2. a first strip of fastening material affixed to the outer surface of one of said portions distant from said slot; and 3. a second strip of cooperative fastening material affixed to the inner surface of the other of said portions distant from said slot, one of said strips containing hook elements and the other containing loop elements.

4. The device as recited in claim 3 wherein said planar member is formed with a slit extending from one of said mounting holes to an outer edge of said member.

5. The device as recited in claim 3 wherein said planar member is formed with a first slit extending from one of said mounting holes to an outer edge of said member, and is formed with a second slit extending from the other of said mounting holes to an outer edge of said member.

6. The device as recited in claim 3 wherein said planar member is formed with a slit extending from one of said mounting holes to said rectangular slot.

7. The device as recited in claim 3 wherein said planar member is formed with a first slit extending from one of said mounting holes to said rectangular slot, and is formed with a second slit extending from the other of said mounting holes to said rectangular slot.

8. The device as recited in claim 3, further comprising a pair of rigid strips of materials affixed to said planar member at said portions, each of said strips having an edge aligned along said parallel lines.

9. A device for securing a pair of mating electrical connectors together, wherein one of said electrical connectors has a pair of mounting holes therein for faciliating mounting to a panel member having cooperating mounting holes therein and an intermediate slot to permit passage of an electrical cable to said one electrical connector, said device comprising 1. a flexible and sturdy planar member having a pair of mounting holes therein oriented so as to co-align with mounting holes in said one electrical connector and said panel member, said planar member having an opening therein at least as large as said panel member intermediate hole, said planar member being formed so that two substantive portions can be folded at right angles in a U shape along parallel lines which extend along opposite sides of said one connector, said portions when folded having inner surfaces facing each other with a space therebetween for housing the other electrical connector;
2. a first strip of fastening material affixed to the outer surface of one of said portions distant from said slot; and
3. a second strip of cooperative fastening material affixed to the inner surface of the other of said portions distant from said slot, one of said strips containing hook elements and the other containing loop elements.

10. A device for securing a pair of mating electrical connectors together, wherein one of said electrical connectors has a pair of mounting holes therein for facilitating mounting to a panel member having cooperating mounting holes therein and an intermediate slot to permit passage of an electrical cable to said one electrical connector, said device comprising 1. a flexible and sturdy planar member having a pair of mounting holes therein oriented so as to co-align with mounting holes in said one electrical connector and said panel member, said planar member having a cooperating rectangular slot therein at least as large as said panel member intermediate slot, said planar member being formed so that two substantive portions can be folded at right angles in a U shape along parallel lines extending from opposite sides of said rectangular slot, said portions when folded having inner surfaces facing each other with a space therebetween for housing the other electrical connector;
2. a first fastening means affixed to one of said portions distant from said slot; and
3. a second cooperative fastening means affixed to the other of said portions distant from said slot.

11. The device as recited in claim 10 wherein said planar member is formed with a slit extending from one of said mounting holes to an outer edge of said member.

12. The device as recited in claim 10 wherein said planar member is formed with a first slit extending from one of said mounting holes to an outer edge of said member, and is formed with a second slit extending from the other of said mounting holes to an outer edge of said member.

13. The device as recited in claim 10 wherein said planar member is formed with a slit extending from one of said mounting holes to said rectangular slot.

14. The device as recited in claim 10 wherein said planar member is formed with a first slit extending from one of said mounting holes to said rectangular slot, and is formed with a second slit extending from the other of said mounting holes to said rectangular slot.

15. The device as recited in claim 10 further comprising a pair of rigid strips of material affixed to said planar member at said portions, each of said strips having an edge aligned along said parallel lines.

16. A device for securing a pair of mating electrical connectors together, wherein one of said electrical connectors has a pair of mounting holes therein for facilitating mounting to a panel member having cooperating mounting holes therein and an intermediate slot to permit passage of an electrical cable to said one electrical connector, said device comprising 1. a flexible and sturdy planar member having a pair of mounting holes therein oriented so as to co-align with mounting holes in said one electrical connector and said panel member, said planar member having an opening therein at least as large as said panel member intermediate slot, said planar member being formed so that two substantive portions can be folded at right angles in a U shape along parallel lines which extnd along opposite sides of said one connector, said portions when folded having inner surfaces facing each other with a space therebetween for housing the other electrical connector;
2. a first fastening means affixed to one of said portions distant from said slot; and
3. a second cooperative fastening means affixed to the other of said portions distant from said slot.

17. In combination, a. a first electrical connector having a pair of mounting holes therein;

b. a panel having cooperating mounting holes therein and an intermedate slot to permit passage of an electrical cable therethrough to said first connector;

c. a second electrical connector having a right angle shape and adapted to mate with said first connector;

d. a flexible and sturdy planar member having a pair of mounting holes therein oriented so as to co-align with mounting holes in said first connector and said panel, said planar member having a cooperative rectangular slot therein at least as large as said panel member intermediate slot, said planar member being formed so that two substantive portions can be folded at right angles in a U shape along parallel lines extending from opposite sides of said rectangular slot, said portions when folded having inner surfaces facing each other with a space therebetween for housing the other electrical connector;

e. a first strip of fastening material affixed to the outer surface of one of said portions distant from said slot;

f. a second strip of cooperative fastening material affixed to the inner surface of the other of said portions distant from said slot, one of said strips containing hook elements and the other containing loop elements; and g. a pair of mounting bolts for fastening said first connector, said planar member, and said panel, in the order named, whereby said portions of said planar member extend outwardly away from said panel, said bolts being inserted into said mounting holes.

18. The combination as recited in claim 17 wherein said planar member is formed with a slit extending from one of said mounting holes to an outer edge of said member.

19. The combination as recited in claim 17 wherein said planar member is formed with a first slit extending from one of said mounting holes to an outer edge of said member, and is formed with a second slit extending from the other of said mounting holes to an outer edge of said member.

20. The combination as recited in claim 17 wherein said planar member is formed with a slit extending from one of said mounting holes to said rectangular slot.

21. The combination as recited in claim 17 wherein said planar member is formed with a first slit extending from one of said mounting holes to said rectangular slot, and is formed with a second slit extending from the other of said mounting holes to said rectangular slot.

22. The combination as recited in claim 17, further comprising a pair of rigid strips of material affixed to said planar member at said portions, each of said strips having an edge aligned along said parallel lines.

23. In combination, a. a first electrical connector having a pair of mounting holes therein;

b. a panel having cooperating mounting holes therein and an intermediate slot to permit passage of an electrical cable therethrough to said first connector;

c. a second electrical connector having a right angle shape and adapted to mate with said first connector;

d. a flexible and sturdy planar member having a pair of mounting holes therein oriented so as to co-align with mounting holes in said first connector and said panel, said planar member having an opening therein at least as large as said panel member intermediate slot, said planar member being formed so that two substantive portions can be folded at right angles in a U shape along parallel lines which extend along opposite sides of said first connector, said portions when folded having inner surfaces facing each other with a space therebetween for housing said second electrical connector;

e. a first strip of fastening material affixed to the outer surface of one of said portions distant from said slot;

f. a second strip of cooperative fastening material affixed to the inner surface of the other of said portions distant from said slot, one of said strips containing hook elements and the other containing loop elements; and g. a pair of mounting bolts for fastening said first connector, said planar member, and said panel, in the order named, whereby said portions of said planar member extend outwardly away from said panel, said bolts being inserted into said mounting holes.

24. In combination, a. a first electrical connector having a pair of mounting holes therein;

b. a panel having cooperating mounting holes therein and an intermediate slot to permit passage of an electrical cable therethrough to said first connector;

c. a second electrical connector having a right angle shape and adapted to mate with said first connector;

d. a flexible and sturdy planar member having a pair of mounting holes therein oriented so as to co-align with mounting holes in said first connector and said panel, said planar member having a cooperating rectangular slot therein at least as large as said panel member intermediate slot, said planar member being formed so that two substantive portions can be folded at right angles in a U shape along parallel lines extending from opposite sides of said rectangular slot, said portions when folded having inner surfaces facing each other with a space therebetween for housing said second electrical connector;

e. a first fastening means affixed to one of said portions distant from said slot; and f. a second cooperative fastening means affixed to the other of said portions distant from said slot.

25. The combination as recited in claim 24 wherein said planar member is formed with a slit extending from one of said mounting holes to an outer edge of said member.

26. The combination as recited in claim 24 wherein said planar member is formed with a first slit extending from one of said mounting holes to an outer edge of said member, and is formed with a second slit extending from the other of said mounting holes to an outer edge of said member.

27. The combination as recited in claim 24 wherein said planar member is formed with a slit extending from one of said mounting holes to said rectangular slot.

28. The combination as recited in claim 24 wherein said planar member is formed with a first slit extending from one of said mounting holes to said rectangular slot, and is formed with a second slit extending from the other of said mounting holes to said rectangular slot.

29. The combination as recited in claim 24, further comprising a pair of rigid strips of material affixed to said planar member at said portions, each of said strips having an edge aligned along said parallel lines.

30. In combination, a. a first electrical connector having a pair of mounting holes therein;

b. a panel having cooperating mounting holes therein and an intermediate slot to permit passage of an electrical cable therethrough to said first connector;

c. a second electrical connector having a right angle shape and adapted to mate with said first connector;

d. a flexible and sturdy planar member having a pair of mounting holes therein oriented so as to co-align with mounting holes in said first connector and said panel, said planar member having an opening therein at least as large as said panel member intermediate slot, said planar member being formed so that two substantive portions can be folded at right angles in a U shape along parallel lines which extend along opposite sides of said rectangular slot, said portions when folded having inner surfaces facing each other with a space therebetween for housing said second electrical connector;

e. a first fastening means affixed to one of said portions distant from said slot;

f. a second cooperative fastening means affixed to the other of said portions distant from said slot, and g. a pair of mounting bolts for fastening said first connector, said planar member, and said panel, in the order named, whereby said portions of said planar member extend outwardly away from said panel, said bolts being inserted into said mounting holes.

31. A device for securing a pair of mating electrical connectors together, wherein a. one of said electrical connectors has a pair of mounting holes therein for facilitating mounting to a panel member having cooperating mounting holes therein and an intermediate slot to permit passage of an electrical cable to said one electrical connector; and wherein b. the other of said electrical connectors has a first strip of fastening material affixed to one side thereof, and has a second strip of fastening material affixed to the opposite side thereof;

said device comprising 1. a one-piece flexible and sturdy planar member having a pair of mounting holes therein oriented so as to co-align with mounting holes in said one electrical connector and said panel member, said planar member having a cooperating rectangular slot therein at least as large as said planar member intermediate slot, said one piece planar member being formed so that two substantive portions can be folded at right angles in a U shape along parallel lines extending from opposite sides of said rectangular slot, said portions when folded having inner surfaces facing each other with a space therebetween for housing the other electrical connector;

2. a third strip of fastening material affixed to the inner surface of one of said portions distant from said slot, one of said first and third strips containing hook elements and the other containing loop elements; and 3. a fourth strip of fastening material affixed to the inner surface of the other of said portions distant from said slot, one of said second and fourth strips containing hook elements and the other containing loop elements.

32. A method assuring the securing of a pair of mating electrical connectors together, wherein one of said electrical connectors has a pair of mounting holes therein for facilitating mounting to a panel member having cooperating mounting holes therein and an intermediate slot to permit passage of an electrical cable to said one electrical connector, said method comprising the steps of a. providing a flexible and sturdy planar member having a pair of mounting holes therein oriented so as to co-align with mounting holes in said one electrical connector and said panel member, said planar member having a cooperating rectangular slot therein at least as large as said panel member intermediate slot, said planar member being formed so that two substantive portions can be folded at right angles in a U shape along parallel lines extending from opposite sides of said rectangular slot, said portions when folded having inner surfaces facing each other with a space therebetween for housing the other electrical connector, a first strip of fastening material affixed to the outer surface of one of said portions distant from said slot, and a second strip of cooperative fastening material affixed to the inner surface of the other of said portions distant from said slot, one of said strips containing hook elements and the other containing loop elements;

b. placing said planar member onto said panel member so that the mounting holes on said members are co-aligned, said member being so oriented so that, when folded, said inner surfaces of said portions face each other;

c. placing said one electrical connector onto said planar member so that the mounting holes are co-aligned;

d. fastening said one electrical connector, said planar member, and said panel member together at said mounting holes;

e. securing the other electrical connector to said one connector;

f. wrapping said one portion of said planar member about said other connector in an intimate manner; and g. wrapping said other portion of said planar member about said other connector and said one portion so that said fastening materials interengage, whereby said connectors are secured.

33. A method of assuring the securing of a pair of mating electrical connectors together, wherein one of said electrical connectors has a pair of mounting holes therein for facilitating mounting to a panel member having cooperating mounting holes therein and an intermediate slot to permit passage of an electrical cable to said one electrical connector, said method comprising the steps of a. providing a flexible and sturdy planar member having a pair of mounting holes therein oriented so as to co-align with mounting holes in said one electrical connector and said panel member, said planar member having a cooperating rectangular slot therein at least as large as said panel member intermediate slot, said planar member being formed so that two substantive portions can be folded at right angles in a U shape along parallel lines extending from opposite sides of said rectangular slot, said portions when folded having inner surfaces facing each other with a space therebetween for housing the other electrical connector, a first strip of fastening material affixed to the outer surface of one of said portions distant from said slot, and a second strip of cooperative fastening material affixed to the inner surface of the other of said portions distant from said slot, one of said strips containing hook elements and the other containing loop elements;

b. placing said planar member onto said panel member so that the mounting holes on said members are co-aligned, said member being so oriented so that, when folded, said inner surfaces of said portions face eath other;

c. placing said one electrical connector onto said planar member so that the mounting holes are co-aligned;

d. fastening said one electrical connector, said planar member, and said panel member together at said mounting holes;

e. affixing a cable to said one electrical connector;

f. folding said portions of said planar member outwardly away from said panel member;

g. wrapping said one portion of said planar member about said other connector in an intimate manner; and h. coupling said other portion of said planar member about said other connector and said one portion so that said fastening materials interengage, whereby said connectors are secured.

34. A method of securing a pair of mating electrical connectors together, wherein one of said electrical connectors has a pair of mounting holes therein mounted by bolts to a panel member having corresponding cooperating mounting holes therein, said panel member having an intermediate slot for permitting an electrical cable affixed to said one connector to pass therethrough, the method utilizing a flexible and sturdy planar member having a pair of mounting holes therein oriented so as to co-align with mounting holes in said one electrical connector and said panel member, said planar member having a cooperating rectangular slot therein at least as large as said panel member intermediate slot, said planar member being formed so that two substantive portions can be folded at right angles in a U shape along parallel lines extending from opposite sides of said rectangular slot, said portions when folded having inner surfaces facing each other with a space therebetween for housing the other electrical connector;

a first strip of fastening material affixed to the outer surface of one of said portions distant from said slot; and a second strip of cooperative fastening material affixed to the inner surface of the other of said portions distant from said slot, one of said strips containing hook elements and the other containing loop elements; and said planar member being formed with a slot extending from one of said mounting holes to said rectangular slot, said method comprising the steps of a. disengaging one of said bolts at one set of aligned mounting holes;

b. positioning said planar member so that the other of said planar member mounting holes is oriented between said one connector and said panel member with the mounting holes co-aligned;

c. engaging said one of said bolts at the aligned mounting hole of said first connector, said planar member, and said panel member;

d. loosening the other of said bolts;

e. positioning said one mounting hole of said planar member above said other bolt which engages the remaining set of aligned mounting holes;

f. bending and manipulating the planar member at both sides of said slit at said one mounting hole so that said planar member at said slot, at said one mounting hole, and at portions between said parallel lines is located between said one connector and said panel member;

g. tightening said other bolt;

h. folding said portions of said planar member outwardly away from said panel member;

i. wrapping said one portion of said planar member about said other connector in an intimate manner; and j. coupling said other portion of said planar member about said other connector and said one portion so that said fastening materials interengage, whereby said connectors are secured.

35. A method of assuring the securing of a pair of mating electrical connectors together, wherein one of said electrical connectors has a pair of mounting holes therein mounted by bolts to a panel member having corresponding cooperating mounting holes therein, said panel member having an intermediate slot for permitting an electrical cable affixed to said one connector to pass therethrough, the method utilizing a flexible and sturdy planar member having a pair of mounting holes therein oriented so as to co-align with mounting holes in said one electrical connector and said panel member, said planar member having a cooperating rectangular slot therein at least as large as said planar member intermediate slot, said planar member being formed so that two substantive portions can be folded at right angles in a U shape along parallel lines extending from opposite sides of said rectangular slot, said portions when folded having inner surfaces facing each other with a space therebetween for housing the other electrical connector;

a first strip of fastening material affixed to the outer surface of one of said portions distant from said slot; and a second strip of cooperative fastening material affixed to the inner surface of the other of said portions distant from said slot, one of said strips containing hook elements and the other containing loop elements; wherein said planar member is formed with a first slit extending from one of said mounting holes to said rectangular slot, and is formed with a second slit extending from the other of said mounting holes to said rectangular slot, said method comprising the steps of a. placing said planar member onto said one connector so that the mounting holes are approximately co-aligned;

b. sliding said planar member along a line joining the two sets of mounting holes in a first direction;

c. bending and manipulating the relatively free end of said planar member, at positions adjacent to one of said slits, so that said portions adjacent to said one slit becomes engaged between said first connector and said panel member;

d. sliding said planar member in a direction opposite to said first direction;

e. bending and manipulating the disengaged end of said planar member, at portions adjacent to the other of said slits, so that said portions adjacent to said other slit becomes engaged between said first connector and said panel members;

f. adjusting and centering said planar member so that said planar member nests smoothly between said parallel portion between said one connector and said panel and wherein said mounting holes are generally co-aligned;

g. mating the other electrical connector with said one electrical connector; and h. wrapping both portions of said planar member about said other connector and to overlap each other so that said fastening materials interengage, whereby said connectors are secured.

* * * * *